US005944091A

United States Patent [19]

Weber

[11] Patent Number: 5,944,091

[45] Date of Patent: Aug. 31, 1999

[54] TANK CONTAINER COOLING SYSTEM

[76] Inventor: Todd A. Weber, 311 South St. #4, Johnson Creek, Wis. 53038

[21] Appl. No.: 09/097,965

[22] Filed: Jun. 16, 1998

[51] Int. Cl.[6] ..... F28F 27/02

[52] U.S. Cl. ..... 165/100; 165/2; 165/65; 169/66; 239/567

[58] Field of Search ..... 165/100, 2, 65; 169/66; 239/567; 137/334

[56] References Cited

U.S. PATENT DOCUMENTS

| | | | |
|---|---|---|---|
| 1,455,789 | 5/1923 | Holmes | 169/66 |
| 3,027,355 | 3/1962 | Taul et al. | 239/567 |
| 4,744,408 | 5/1988 | Pearson et al. | 165/2 |

FOREIGN PATENT DOCUMENTS

| | | | |
|---|---|---|---|
| 2613631 | 10/1988 | France | 169/66 |
| 575313 | 4/1931 | Germany | 169/66 |
| 2408-974 | 2/1973 | Germany | 169/313 |
| 1-279083 | 11/1989 | Japan | 169/66 |
| WO 83/01200 | 4/1983 | WIPO | 169/66 |

*Primary Examiner*—Ira S. Lazarus

[57] ABSTRACT

A new tank container cooling system for preventing tank containers, especially bulk fuel storage containers, from overheating. The inventive device includes a main conduit fluidly connected to a fluid reservoir. At least one delivery conduit is in fluid communication with the main conduit to permit passage of fluid from the fluid reservoir to the delivery conduit. The delivery conduit is generally ring shaped and has a plurality of outflow nozzles. The delivery conduit is adapted for mounting on a storage container such that fluid passing out of the output nozzles flows on the storage container.

11 Claims, 3 Drawing Sheets

TANK CONTAINER COOLING SYSTEM

BACKGROUND OF THE INVENTION

1. Field of the Invention

The present invention relates to cooling systems for tank containers, in particular bulk fuel storage tanks and more particularly pertains to a new tank container cooling system for preventing tank containers, especially bulk fuel storage containers, from overheating.

2. Description of the Prior Art

The use of cooling systems for tank containers, in particular bulk fuel storage tanks is known in the prior art. More specifically, cooling systems for tank containers, in particular bulk fuel storage tanks heretofore devised and utilized are known to consist basically of familiar, expected and obvious structural configurations, notwithstanding the myriad of designs encompassed by the crowded prior art which have been developed for the fulfillment of countless objectives and requirements.

Known prior art cooling systems for tank containers, in particular bulk fuel storage tanks include U.S. Pat. No. 4,812,286; U.S. Pat. No. 3,995,687; U.S. Pat. No. 4,098,324; U.S. Pat. No. Des. 280,545; U.S. Pat. No. 4,075,798; and U.S. Pat. No. 4,179,902.

While these devices fulfill their respective, particular objectives and requirements, the aforementioned patents do not disclose a new tank container cooling system. The inventive device includes a main conduit fluidly connected to a fluid reservoir. At least one delivery conduit is in fluid communication with the main conduit to permit passage of fluid from the fluid reservoir to the delivery conduit. The delivery conduit is generally ring shaped and has a plurality of outflow nozzles. The delivery conduit is adapted for mounting on a storage container such that fluid passing out of the output nozzles flows on the storage container.

In these respects, the tank container cooling system according to the present invention substantially departs from the conventional concepts and designs of the prior art, and in so doing provides an apparatus primarily developed for the purpose of preventing tank containers, especially bulk fuel storage containers, from overheating.

SUMMARY OF THE INVENTION

In view of the foregoing disadvantages inherent in the known types of cooling systems for tank containers, in particular bulk fuel storage tanks now present in the prior art, the present invention provides a new tank container cooling system construction wherein the same can be utilized for preventing tank containers, especially bulk fuel storage containers, from overheating.

The general purpose of the present invention, which will be described subsequently in greater detail, is to provide a new tank container cooling system apparatus and method which has many of the advantages of the cooling systems for tank containers, in particular bulk fuel storage tanks mentioned heretofore and many novel features that result in a new tank container cooling system which is not anticipated, rendered obvious, suggested, or even implied by any of the prior art cooling systems for tank containers, in particular bulk fuel storage tanks, either alone or in any combination thereof.

To attain this, the present invention generally comprises a main conduit fluidly connected to a fluid reservoir. At least one delivery conduit is in fluid communication with the main conduit to permit passage of fluid from the fluid reservoir to the delivery conduit. The delivery conduit is generally ring shaped and has a plurality of outflow nozzles. The delivery conduit is adapted for mounting on a storage container such that fluid passing out of the output nozzles flows on the storage container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tank container cooling system apparatus and method which has many of the advantages of the cooling systems for tank containers, in particular bulk fuel storage tanks mentioned heretofore and many novel features that result in a new tank container cooling system which is not anticipated, rendered obvious, suggested, or even implied by any of the prior art cooling systems for tank containers, in particular bulk fuel storage tanks, either alone or in any combination thereof.

It is another object of the present invention to provide a new tank container cooling system which may be easily and efficiently manufactured and marketed.

It is a further object of the present invention to provide a new tank container cooling system which is of a durable and reliable construction.

An even further object of the present invention is to provide a new tank container cooling system which is susceptible of a low cost of manufacture with regard to both materials and labor, and which accordingly is then susceptible of low prices of sale to the consuming public, thereby making such tank container cooling system economically available to the buying public.

Still yet another object of the present invention is to provide a new tank container cooling system which provides in the apparatuses and methods of the prior art some of the advantages thereof, while simultaneously overcoming some of the disadvantages normally associated therewith.

Still another object of the present invention is to provide a new tank container cooling system for preventing tank containers, especially bulk fuel storage containers, from overheating.

Yet another object of the present invention is to provide a new tank container cooling system which includes a main conduit fluidly connected to a fluid reservoir. At least one delivery conduit is in fluid communication with the main conduit to permit passage of fluid from the fluid reservoir to the delivery conduit. The delivery conduit is generally ring shaped and has a plurality of outflow nozzles. The delivery conduit is adapted for mounting on a storage container such that fluid passing out of the output nozzles flows on the storage container.

Still yet another object of the present invention is to provide a new tank container cooling system that keeps bulk fuel storage tanks cool to prevent them from exploding due to overheating.

Even still another object of the present invention is to provide a new tank container cooling system that if a fire breaks out in a fuel storage facility, the cooling system keeps the storage tanks cool and wet to prevent them from overheating or catching on fire from the fire in the facility.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
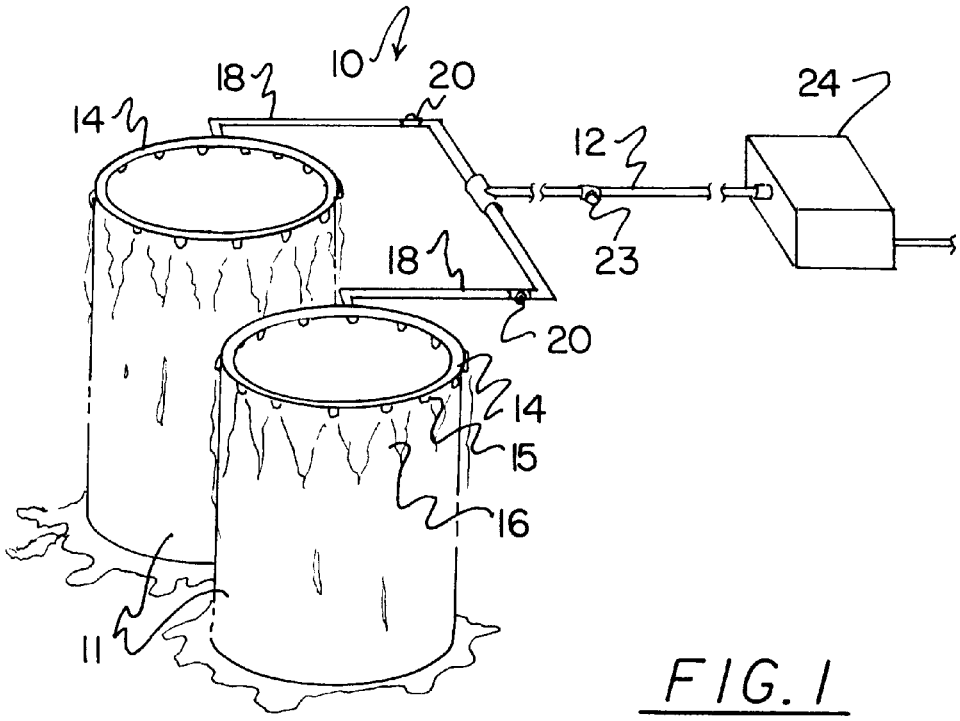
FIG. 1 is a schematic perspective view of a new tank container cooling system for two upright cylindrical storage containers according to the present invention.

With reference now to the drawings, and in particular to FIGS. 1 through 5 thereof, a new tank container cooling system embodying the principles and concepts of the present invention and generally designated by the reference numeral 10 will be described.

Figure 2:
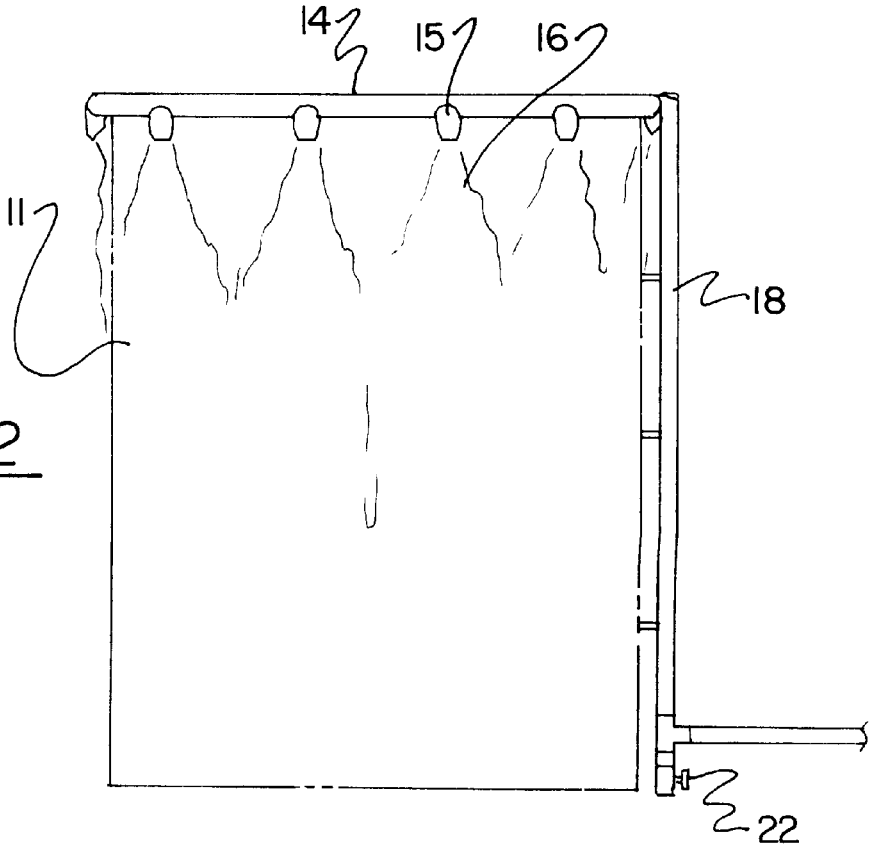
FIG. 2 is a schematic side view of the present invention directing fluid flow over the outer surface of a storage container.
Figure 3:
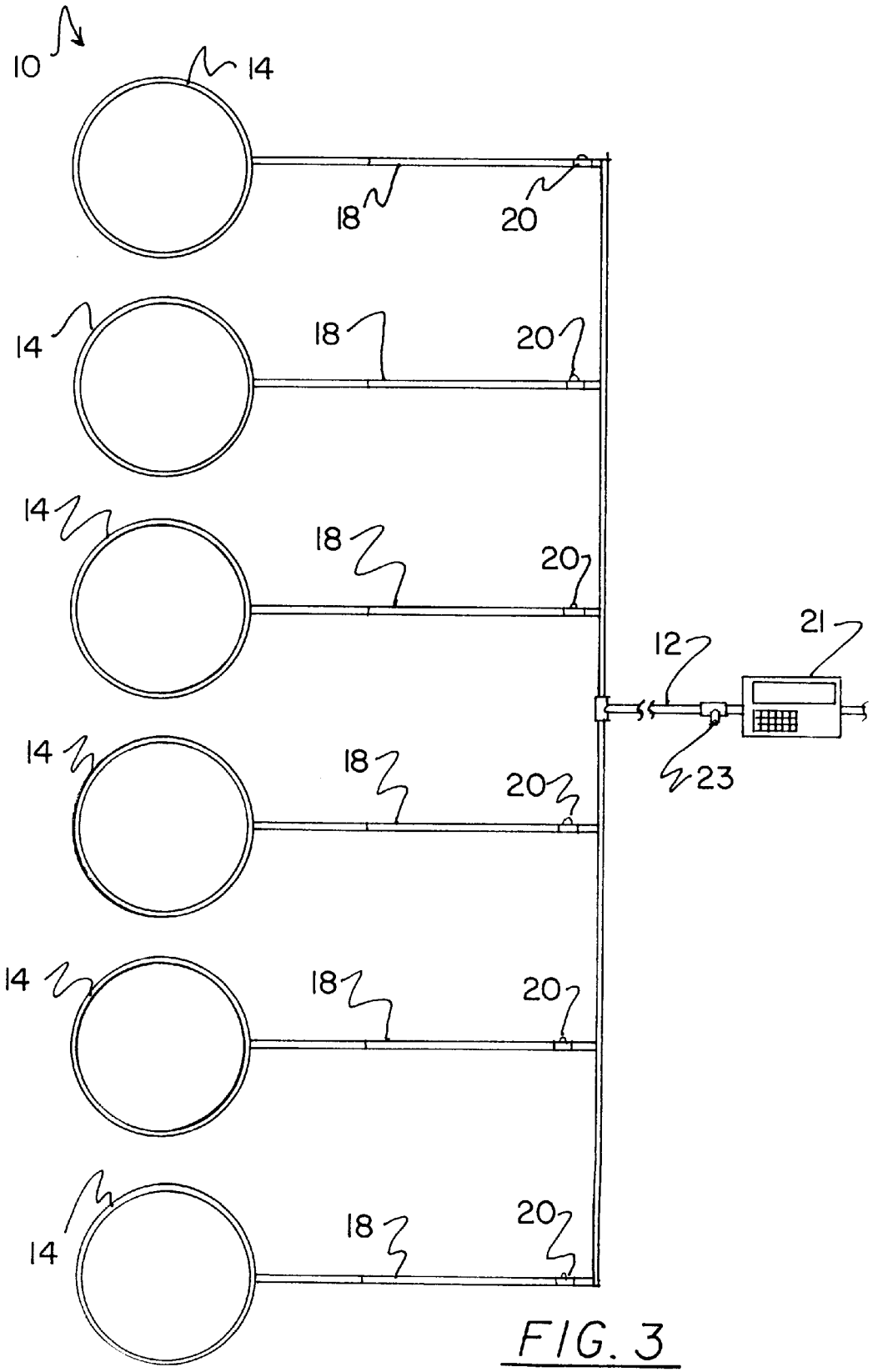
FIG. 3 is a schematic top view of the present invention for six upright cylindrical storage containers.

In use, the cooling system 10 is designed for at least one storage container 11 such as a bulk fuel storage tank. FIG. 1 illustrates a system having two storage tanks while FIG. 3 depicts a system designed for six storage tanks. As best illustrated in FIGS. 1 through 5, the tank container cooling system 10 generally comprises a main conduit 12 fluidly connected to a fluid reservoir. At least one delivery conduit 14 is in fluid communication with the main conduit 12 to permit passage of fluid 16 from the fluid reservoir to the delivery conduit 14. The delivery conduit 14 is generally ring shaped and has a plurality of outflow nozzles 15. The delivery conduit 14 is adapted for mounting on a storage container 11 such that fluid 16 passing out of the output nozzles 15 flows on the storage container 11.

Figure 4:
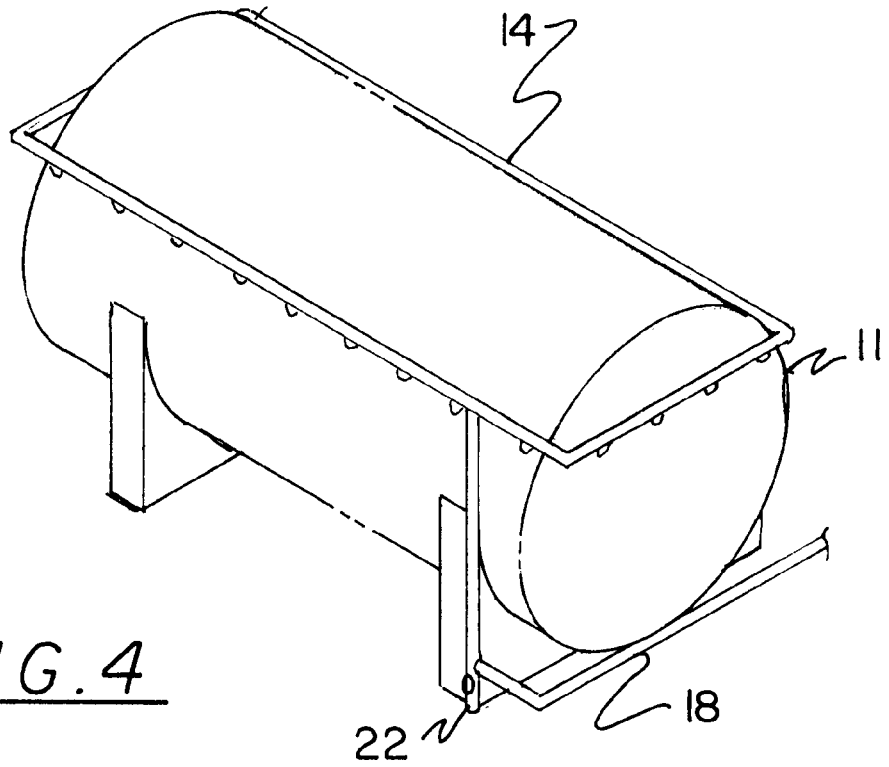
FIG. 4 is a schematic perspective view of a rectangular delivery conduit of the present invention on a horizontal cylindrical storage container.
Figure 5:
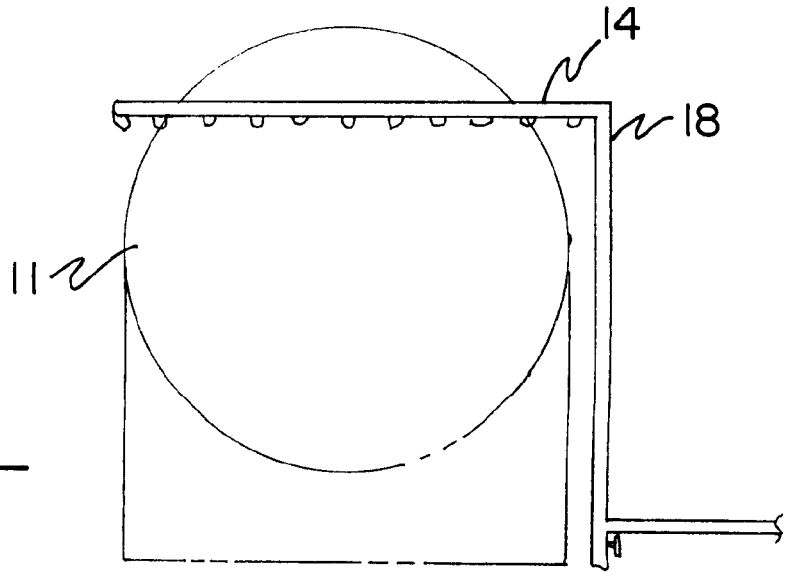
FIG. 5 is a schematic side view of FIG. 4.

In closer detail the main conduit 12 is fluidly connected to a fluid reservoir. The fluid reservoir is preferably a water reservoir that may optionally also include a solution fire retardant chemicals. At least one delivery conduit 14 is provided in fluid communication with the main conduit 12 to permit passage of fluid 16 from the fluid reservoir to the delivery conduit 14. The delivery conduit 14 is preferably generally ring shaped and has a plurality of spaced apart outflow nozzles 15 to permit passage of fluid 16 out of the delivery conduit 14. The delivery conduit 14 is adapted for mounting on a storage container 11, preferably on the top of the storage container, such that fluid 16 passing out of the output nozzles 15 flows on the storage container. As illustrated in FIGS. 1, 2, and 3, the delivery conduit 14 may be shaped to have a generally circular periphery for mounting on to upright extending cylindrical storage tanks 11. As illustrated in FIGS. 4 and 5, the delivery conduit 14 may also be shaped to have a generally rectangular periphery for mounting on to horizontally extending cylindrical storage tanks 11.

Preferably, a secondary conduit 18 fluidly connects each delivery conduit 14 to the main conduit 12. Each secondary conduit 18 preferably has a control valve 20 for selectively opening and closing passage of fluid 16 through the secondary conduit 18 to the delivery conduit 14. A remote controller 21 is operatively connected to the control valve 20 of each of the provided secondary conduits for remotely controlling opening and closing the control valves 20. Preferably, the remote controller can open and shut each of the control valves individually so that a user can selectively direct flow of fluid to any particular delivery conduit.

In the preferred embodiment, each of the secondary conduits 18 has a drain valve 22 for releasing fluid 16 contained in the secondary conduit 18. The drain valve 22 is positioned between the delivery conduit 14 and the control valve 20. Optionally, the main conduit 12 may also include a main shutoff valve 23 for selectively closing passage of fluid 16 through the main conduit 12. In use, the valves are opened to permit fluid to flow from the fluid reservoir and out through the nozzles to cool the storage tank with the fluid. Preferably, the main conduit 12 has a pump 24 for pumping fluid 16 from the fluid reservoir through the main conduit 12 to the delivery conduit 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cooling system for a storage container, said cooling system comprising:

a storage container having an outer perimeter wall with an exterior surface;

a main conduit being fluidly connected to a fluid reservoir;

at least one delivery conduit in fluid communication with said main conduit to permit passage of fluid from said fluid reservoir to said delivery conduit, said delivery conduit being located adjacent to the exterior surface of the outer perimeter wall of said storage container;

said delivery conduit having a plurality of outflow nozzles, said outflow nozzles being positioned adjacent to the exterior surface of said perimeter wall with said outflow nozzles being adapted to spray fluid onto the exterior surface of said perimeter wall; and said delivery conduit being adapted for mounting on a storage container such that fluid passing out of said output nozzles flows on said storage container, wherein said delivery conduit is tubular with a substantially continuous perimeter wall for preventing contact between said fluid and said storage container until said fluid passes through said outflow nozzles.

2. The cooling system of claim 1, wherein each said delivery conduit is generally ring shaped for positioning adjacent to an upper portion of a vertically extending cylindrical storage container, each of said delivery conduits lying on a common horizontal plane with an upper face of the storage container.

3. The cooling system of claim 1, wherein each said delivery conduit is generally rectangular shaped for mounting adjacent to an upper portion of a horizontally extending cylindrical storage container, each of said delivery conduits lying on a common horizontal plane with an upper face of the storage container.

4. The cooling system of claim 1, wherein a secondary conduit fluidly connects said delivery conduit to said main conduit.

5. The cooling system of claim 4, wherein said secondary conduit has a control valve for selectively opening and closing passage of fluid through said secondary conduit to said delivery conduit.

6. The cooling system of claim 5, further comprising a remote controller being operatively connected to said control valve for remotely controlling opening and closing said control valve.

7. The cooling system of claim 5, wherein said secondary conduit has a drain valve for releasing fluid contained in said secondary conduit, said drain valve being positioned between said delivery conduit and said control valve.

8. The cooling system of claim 1, further comprising a pump for pumping fluid from said fluid reservoir through said main conduit to said delivery conduit.

9. The cooling system of claim 1, wherein the fluid reservoir contains a fluid comprising a fire retardant chemical.

10. A cooling system for at least two storage containers such as bulk fuel storage tanks, said cooling system comprising:

a main conduit being fluidly connected to a fluid reservoir, the fluid reservoir containing a fluid comprising a fire retardant chemical;

at least two tubular delivery conduits in fluid communication with said main conduit to permit passage of fluid from said fluid reservoir to said delivery conduits;

each of said delivery conduits being generally ring shaped for positioning adjacent to an upper portion of a vertically extending cylindrical storage container, each of said delivery conduits having a plurality of outflow nozzles;

each of said delivery conduits being adapted for mounting on a storage container such that fluid passing out of said output nozzles flows on said storage containers, each of said delivery conduits lying on a common horizontal plane with an upper face of an associated storage container;

wherein each of said delivery conduits has a generally annular transverse cross section with a substantially continuous perimeter wall for preventing contact between said fluid and said storage container until said fluid passes through said outflow nozzles;

wherein a secondary conduit fluidly connects said delivery conduits to said main conduit;

said secondary conduit having at least two control valves for selectively opening and closing passage of fluid through said secondary conduit to said delivery conduits;

a remote controller being operatively connected to said control valves for remotely controlling opening and closing said control valves, said remote controller permitting independent selective opening and closing of said control valves;

said secondary conduit having a drain valve for releasing fluid contained in said secondary conduit, said drain valve being positioned between said delivery conduit and one of said control valves; and a pump for pumping fluid from said fluid reservoir through said main conduit to said delivery conduits.

11. A cooling system for at least two storage containers such as bulk fuel storage tanks, said cooling system comprising:

a main conduit being fluidly connected to a fluid reservoir;

a tubular delivery conduit in fluid communication with said main conduit to permit passage of fluid from said fluid reservoir to said delivery conduits;

said delivery conduit having a plurality of outflow nozzles;

said delivery conduit being adapted for mounting on a storage container such that fluid passing out of said output nozzles flows on said storage container, said delivery conduits lying on a common horizontal plane with an upper face of an associated storage container;

wherein a secondary conduit fluidly connects said delivery conduits to said main conduit;

said secondary conduit having a control valve for selectively opening and closing passage of fluid through said secondary conduit to said delivery conduits;

a remote controller being operatively connected to said control valves for remotely controlling opening and closing said control valves, said remote controller permitting independent selective opening and closing of said control valves;

said secondary conduit having a drain valve for releasing fluid contained in said secondary conduit, said drain valve being positioned between said delivery conduit and one of said control valves; and a pump for pumping fluid from said fluid reservoir through said main conduit to said delivery conduits.

* * * * *